United States Patent [19]

Francis, Jr.

[11] 4,097,853

[45] Jun. 27, 1978

[54] MEANS FOR DISTINGUISHING MOTION FROM NOISE IN AN INTRUSION ALARM SYSTEM

[75] Inventor: Ralph M. Francis, Jr., Racine, Wis.

[73] Assignee: Milwaukee Resistor Corporation, Milwaukee, Wis.

[21] Appl. No.: 725,026

[22] Filed: Sep. 20, 1976

[51] Int. Cl.[2] ..... G08B 13/16

[52] U.S. Cl. ..... 340/258 A; 340/3 D; 340/258 B; 343/5 PD

[58] Field of Search ..... 340/258 A, 258 B, 258 D, 340/1 R, 3 D; 343/5 PD

[56] References Cited

U.S. PATENT DOCUMENTS

| | | | |
|---|---|---|---|
| 2,794,974 | 6/1957 | Bagno et al. | 340/258 A |
| 3,582,870 | 6/1971 | Peterson et al. | 340/1 |
| 3,614,724 | 10/1971 | Brown et al. | 340/16 R |
| 3,754,222 | 8/1973 | Eisenberg | 340/258 A |
| 3,801,977 | 4/1974 | Cotter | 340/258 A |
| 3,885,234 | 5/1975 | Fujimoto | 340/258 A |
| 3,976,988 | 8/1976 | Fujimoto | 340/258 A |

*Primary Examiner*—John W. Caldwell, Sr.

*Assistant Examiner*—Joseph E. Nowicki

*Attorney, Agent, or Firm*—Ralph G. Hohenfeldt

[57] ABSTRACT

Composite noise and information signals are amplified and filtered to segregate high and low frequency bands that correspond with noise from an intermediate frequency band which corresponds with the information signal. The absolute values of the two noise band signals are summed, weighted, and compared with the information band signal in an operational amplifier whose output tends toward a signal of one polarity with respect to a reference voltage due to noise and tends toward the opposite polarity due to the information band frequency. The signal is integrated and used to control an alarm circuit and environmental noise indicating devices. Means are provided to reduce sensitivity of one of the devices in the presence of high noise and to restore sensitivity if a valid information signal occurs. The other device is used to warn of persistent environmental noise that might be eliminated. The input amplifier of the system is provided with a feedback circuit that brings about compressor action to null the effect of high transient noises.

24 Claims, 5 Drawing Figures

MEANS FOR DISTINGUISHING MOTION FROM NOISE IN AN INTRUSION ALARM SYSTEM

BACKGROUND OF THE INVENTION

This invention relates to systems for detecting an intruder in a protected area and is particularly concerned with improving the capability of such systems for distinguishing information signals that result from actual entry of an intruder into the protected area from signals that are due to extraneous noise. More generally, the principles and embodiment of the noise and information signal discriminator described hereinafter in relation to an intrusion alarm system has many other applications where signals of one kind must be distinguished from signals of another kind. For example, the invention is useable in biological signal detecting and identifying systems and in audio systems where the objectives may be to process signals and reconstitute them or to derive an indication as to whether certain kinds of signals are properly sorted.

The invention will be illustrated herein in a system that radiates sound waves in the audible frequency range and detects phase shifts in reflected radiation caused by movements of an intruder, but the concepts and principles of the invention are applicable to systems that use ultrasonic and electromagnetic radiation too.

In general, intrusion alarm systems of the type under consideration radiate energy into the protected area and detect changes in incident radiation due to the presence of an intruder. In one type of system, an alarm is produced in response to the difference in frequency between the radiated and reflected signals that results from the presence of an intruder. In another type of system, an alarm is produced in response to the shift in the phase of the reflected signal relative to the radiated signal resulting from entry of an intruder in the protected area. A serious problem with prior systems is the occurrence of false alarms due to a wide variety of extraneous causes which may be characterized as noise. Typical causes of noise are moving air currents caused by normal temperature gradients, air conditioning or heating systems, movement of drapes or window shades, vibrating walls and light fixtures, passing vehicles, sonic booms, earth tremors, lightning or corona discharge and the movement of small objects such as rodents and fast moving objects such as fans.

A variety of schemes have been proposed for enabling intrusion alarm systems to distinguish true movements of a human intruder in a protected area from noise. Basically, most of these systems depend on identifying a phase shift or frequency difference range that is characteristic of movement by an object as large as a human body and then using a band pass filter which produces an output for only the identified frequency or phase shift range. This approach disregards the effect of noise in the useful information range which is one of the underlying causes of false alarms. The specified frequency or phase change in the information range is simply detected and amplified and used to trigger an alarm circuit.

Noise may be classified into two general types, one being transient and the other being persistent. Obviously, it would be desirable to not have an alarm condition indicated when a noise or disturbance occurs on a one-time or transient basis nor should an alarm condition occur when there is a persistent noise or disturbance resulting from something other than normal motion. However, in prior art band pass noise discriminating schemes, if a transient or persistent noise results in a sufficient signal amplitude change due to phase shift or frequency change within the band pass selected, it is processed as a real information signal and a false alarm results.

SUMMARY OF THE INVENTION

Among the objects of the present invention are to provide a system in which there is automatic compensation for transient disturbances, long term disturbances not due to motion changes, sensitivity variations between small and large rooms, and to provide means for visually indicating to the installer or user of a system that an abnormally disturbed or noisy environment exists.

A further object is to provide a noise compensating circuit characterized by good immunity to intense transient noises.

Still another object is to provide a noise compensating circuit wherein there is no substantial loss of sensitivity to true information signals during occurrence of intense transient noise or persistent low level noise.

Yet another object is to provide means for obtaining uniform sensitivity to wanted signals regardless of the size or reflectivity of the enclosure in which the intruder detection system is installed.

Another important object and feature of the invention is the provision of means for decreasing signal gain during the existence of high noise but returning the system to maximum gain if true motion is detected in the protected area for a short period.

Another object of the invention is to provide a noise compensating circuit which can be installed readily in existing intrusion detecting systems of the radiation type.

Another object is to provide for permitting an increase in the amount of motion required in the protected environment before an alarm condition is produced but without incurring any loss of range or distance at which detection occurs under mildly noisy conditions.

Still another object is to provide an indication of the amount of noise present at any time during operation of the system so that corrective measures may be taken to reduce noise and its causes before a critical noise level occurs.

How the foregoing objects and other more specific objects of the invention are achieved will be evident in the course of a more detailed description of a preferred embodiment of the invention which will be set forth hereinafter.

In general terms, an intrusion detector and alarm system in which the new noise and motion comparator circuitry is employed may comprise one or more speakers located within each protected area. An oscillator which generates audio frequency signals in a range of about 400 to 2000 Hz but preferably about 800 Hz is used to drive the speakers which radiate energy at that frequency into the protected area. Each speaker also receives a spectrum of reflected audio signals resulting from motion by an intruder and from noise that is generated in the protected area. The system also includes a phase sensitive detector which is coupled to the speakers and to the oscillator. The detector operates substantially independently of the amplitude of reflected signals to provide an output signal corresponding with phase variations therein due to movement of an intruder and to noise as well.

The output of the phase sensitive detector has no dc component but it does have an ac characteristic dependent on phase shift. This output is coupled by means of an impedance matching amplifier to the new noise discriminator part of the circuitry.

In the new comparator, the detected signal is amplified to a useful level. The amplifier is provided with a feedback loop which causes compressor action so that the circuit has good immunity to very loud transient noises and can be adjusted for uniform sensitivity for large and small protected reflective environments. The amplified input signal is further processed in a state variable filter which has high-pass, bandpass and low-pass filtered outputs which respectively correspond with primarily noise, noise plus information signal and noise in that order.

The signals from the high-pass, bandpass and low-pass active filters are respectively converted to their absolute values in individual absolute value amplifiers. The output signals from the high-pass and low-pass absolute value amplifiers are summed at the inverting input terminal of an operational amplifier. The output from the bandpass absolute value amplifier is fed to the noninverting input of this operational amplifier. The action in the operational amplifier is such that its output varies in respect to a reference voltage. In this example, when the offset of the output waveform is positive an alarm condition is indicated. A predominantly noise condition is indicated by the offset being negative with respect to the reference voltage.

The output signals from the operational amplifier are integrated and if the result has one polarity an alarm is effectuated but if it has the opposite polarity indicative of net noise, no alarm is produced.

The system also has a visual indicator in a test circuit which can be used to determine the amount of background noise in the protective environment so that noise can be minimized by relocating the sensors or readjusting a noise balance potentiometer to maximize sensitivity of the system in the presence of noise before the system is placed in operation.

The new noise and true signal comparator or discriminator does not follow the prior practice of trying to detect and emphasize a signal supposedly exclusively in a frequency or information band corresponding with true intruder movement and using the derived signal to trigger an alarm. Instead, the new comparator or discriminator is based on the important observation that noise extends over the entire frequency spectrum, including the information band, and action is taken to account for noise in the information band too so a signal indicative of true intruder movement can be derived. Another premise of the new circuit is that the integral of truly random noise is zero and that the bandpass which includes the true information signal can be weighted by subtracting signals corresponding with low-pass and high-pass from the total signal.

In the system illustrated herein, in which the frequency of the sound radiated to the protected area is 810 Hz, for example, the frequency band of the information signal due to true intruder movement has been determined to be 0.5 Hz to 6 Hz and it has been found that the noise bandwidth is about from 0.1 Hz to 20 Hz.

A more detailed description of an illustrative embodiment of the invention will now be set forth in reference to the drawings.

DESCRIPTION OF A PREFERRED EMBODIMENT

An intrusion detection system in which the improved noise and motion distinguishing circuit may be used is shown in U.S. Pat. No. 3,754,222. A part of this prior system will be outlined in reference to FIG. 1 to provide background information.

Figure 1:
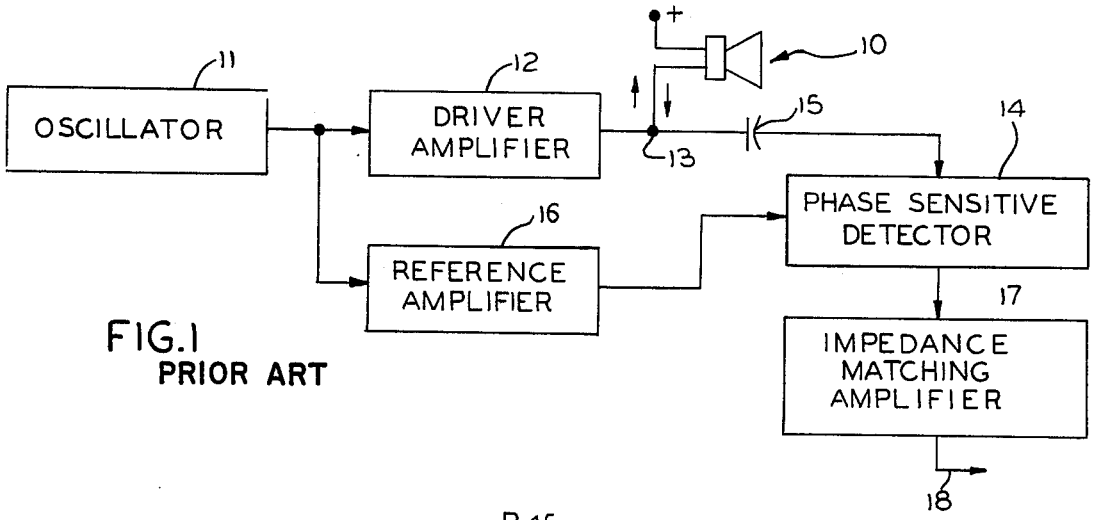
FIG.1 PRIOR ART
FIG. 1 is a block diagram of a part of a prior art intruder detecting device with which the new noise and motion comparator device may be used advantageously.

The FIG. 1 system comprises a speaker 10 that is located in a room or other confined area in which entry by an intruder is to be detected. Speaker 10 is driven such that it floods the protected area with an audible tone, having a frequency of 810 Hz in this example, but lower or higher frequencies such as into the ultrasonic range may be used in systems adapted for some environments. In a commercial embodiment, one or more speakers are used. The speakers may be practically any common type.

Speaker 10, besides emitting sound for radiation into the protected area, senses sound that is reflected from the walls of the room and from objects therein and from intruders and it also senses what has been referred to previously as noise. When an intruder enters the protected area there is a phase shift of the reflected sound received by the speaker relative to the sound radiated by the speaker. Detection of phase shift, distinct from noise and any environmental disturbances, is an indication of an intruder moving in the protected area. This effects an alarm condition.

In FIG. 1, the output of an audio frequency oscillator 11 is fed to a driver amplifier 12 whose output terminal is connected to an input of the speaker to drive the speaker. Driver amplifier 12 is operated in saturation. The signal resulting from combining, at the junction point 13, the outgoing signal to the speaker with the signal returned to from the speaker is coupled to a phase sensitive detector 14 through a capacitor 15. The phase detector 14 is also supplied with a signal from a reference amplifier 15 which is driven by the audio frequency oscillator 11. As in the cited patent, the phase sensitive detector operates substantially independently of the amplitude of reflected signals to provide an output signal when the phase of a reflected signal varies due to movement of an intruder within the protected area. Detector 14 detects noise as a result of the phase shift noise causes. Of course, the output signal from detector 14 is also affected by noise in the protected area and by normal circuit jitter as well and it is the purpose of the improvements in the circuitry which are to be described later to distinguish transient and long-term disturbances due to causes other than entry of an intruder from phase shift or signal changes resulting from an intruder so that the system will not produce false alarms.

In the FIG. 1 system, the output signal from phase sensitive detector 14 is fed to an impedance matching or transforming amplifier 17 as in the cited patent and the output 18 from this amplifier is the signal which is further processed in the improved circuitry which distinguishes noise signal from signals that result from true motion of an intruder.

Figure 2:
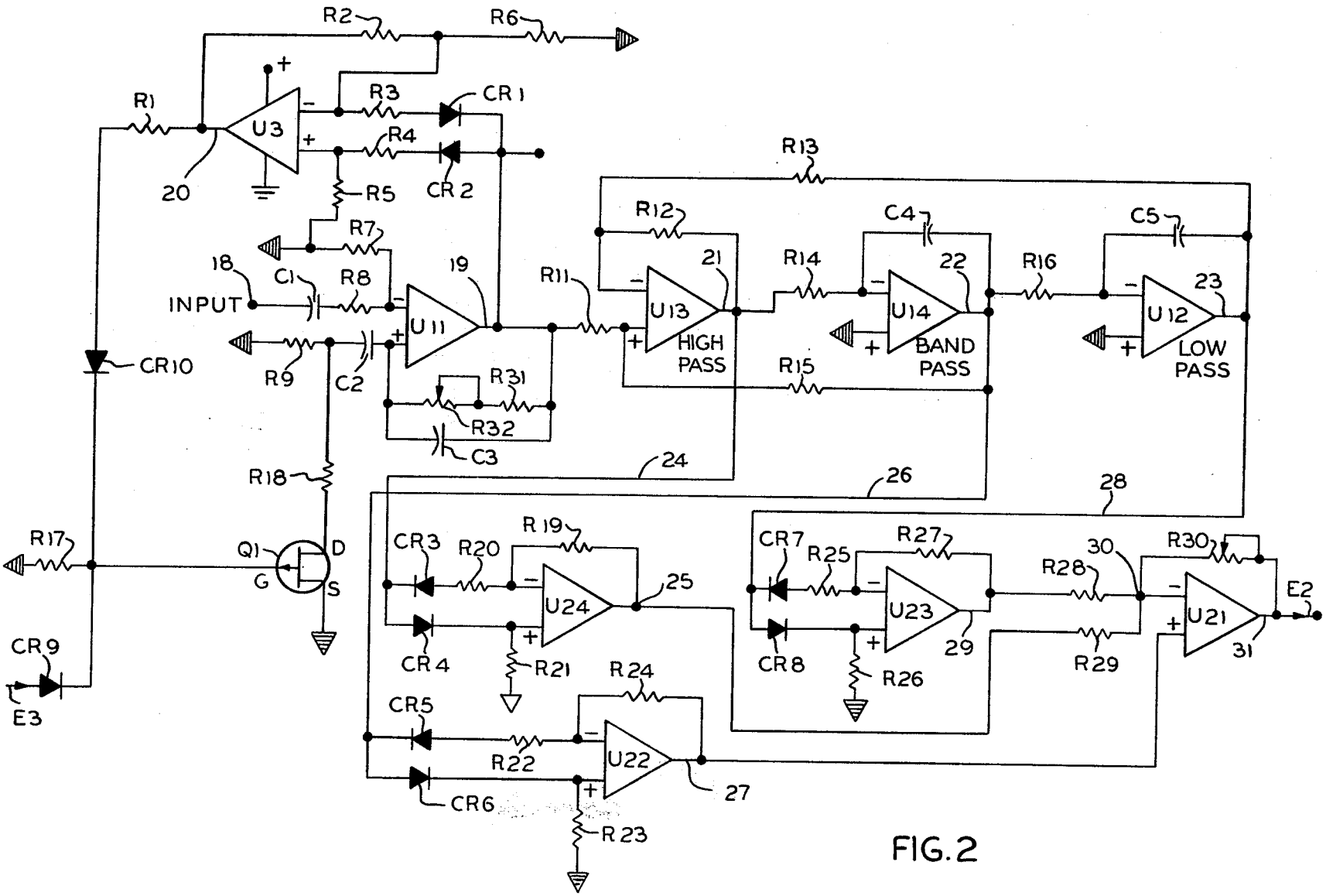
FIG. 2 is a diagram of a circuit for processing detected combined noise and information signals in accordance with the invention.

Refer now to the improved noise comparator circuitry shown in FIG. 2. The phase detected signal comprised of a spectrum of frequencies and appearing at the output terminal 18 of impedance matching amplifier 17 is delivered to the input pin, which is also marked 18, in the upper left region of this figure and which connects to the noninverting input of an operational amplifier U11.

Operational amplifier U11 has basically conventional biasing circuitry including resistors R7, R8, R9, R18 and R31. Signals are coupled to the noninverting and inverting inputs of operational amplifier U11 through capacitors C1 and C2, respectively, and as a result, this amplifier has unity dc gain. The biasing and feedback resistor values are so chosen in this example that operational amplifier U11 has a stable closed loop gain capability of about 1200, for example, and a bandwidth of about 0.1 Hz to 20 Hz. The high gain results in a signal of adequate amplitude at the output terminal 19 of U11 to make subsequent signal processing easier. A variable resistor R32 in series with resistor R31 in the feedback circuit enables adjusting the sensitivity of U11. Capacitor C3 provides rolloff at about 20 Hz.

The 0.1 Hz, which is near dc, to 20 Hz bandwidth of U11 is broad enough to pick up all noise or spurious signals as well as the signal frequency range of 0.5 Hz to 6 Hz which is the range that has been found to be indicative of movement by an intruder in the protected area at the particular radiated frequency used in this illustrative system. As will be evident later, the subsequent circuitry treats any part of the signal below 0.5 Hz and above 6 Hz as noise and discriminates against it.

The output from operational amplifier U11 varies in amplitude with noise falling within the 0.1 Hz to 20 Hz bandwidth of the amplifier and, of course, if an intruder is moving in the protected area, there will be a pronounced signal component plus noise in the 0.5 Hz to 6 Hz band.

The output signal from operational amplifier U11 is fed to an operational amplifier U3 which is connected as an absolute value amplifier. Negative going signals from U11 are coupled through diode CR1 and resistor R3 to the inverting terminal of U3. Positive going signals from U11 are coupled through diode CR2 and R4 to the noninverting input of U3. Resistors R3 and R4 are equal. The amplifier feedback resistor R2 and input resistors R3 and R4 form a divider circuit with R6 in the noninverting input. The input resistors are chosen to obtain symmetry at the inverting and noninverting input so that positive and negative signals are equally amplified. R5 and R6 are connected to ground which, in this circuit, for purposes which will be explained later, is a floating ground at the midpoint between supply voltage and true ground. As will appear, these grounds and all of the ground connections shown in the circuit in association with operational amplifiers are floating in the sense that they are at the midpoint between the power supply voltage and true ground. For instance, the single polarity power supply used in a practical case had an output of 15 volts with respect to ground. The floating ground appearing at the midpoint of a divider which will be explained later, therefore, is actually 7.5 volts above ground and below the supply voltage.

Absolute value amplifier U3 is in a feedback loop with amplifier U11 and causes compressor action in U11. The feedback loop leads from the output terminal 20 of U3 and includes R1, CR10 and the gate electrode of a field effect transistor Q1. The source terminal S of Q1 is connected to floating ground. Its drain terminal D is connected to R18 at the midpoint between R9 and C2. The feedback control voltage is developed across R17 which is connected to floating ground. Q1 serves as a variable resistor. It enables U11 to be operated in the compressor amplifier mode. It prevents U11 from being driven into saturation which could undesirably result in a clipped output signal if very high signals due to noise disturbances or motion should happen to occur. This compressor action results in the circuit having good immunity to very loud transient noises and it promotes uniform sensitivity for a range of very large to very small reflective protected environments. Where sensitivity in a small room would be inherently extreme, the compressor stage serves to limit. There is also further control of Q1 with feedback by means of a circuit which includes diode CR9 in FIG. 2 and an input terminal E3 as will be discussed later.

Those who are skilled in the art will appreciate that a logarithmic amplifier, not shown, could be used in place of the signal compressor circuitry comprised of operational amplifier U11 and its associated feedback circuitry. In fact, any input stage whose output signal changes in relation to the input signal coming in at terminal 18 so that the subsequently processed signal is unclipped and has a magnitude which is sufficient for proper processing may be used.

The output from operational amplifier U11 is fed to a state variable filter, sometimes called a universal active filter, comprising operational amplifiers U13, U14 and U12. U13 is in the high-pass filter stage, U14 is in the bandpass stage and U12 is in the low-pass stage. This filter circuit is familiar to those skilled in the electronics art so its components will be identified and its characteristics as they are pertinent to the present invention will be mentioned but the detail of its operating mode need not be discussed.

The input to the state variable filter is through input resistor R11 which couples with a feedback resistor R15 in the noninverting circuit. There is also a feedback resistor R12 and an input resistor R13 in the inverting circuit. Operational amplifier U14 in the bandpass stage operates as an inverting integrator and has an input resistor R14 and integrating capacitor C4. Operational amplifier U12 is in the low-pass stage and it has an input resistor R16 and integrating capacitor C5.

The output of the high-pass filter section is marked 21. The high-pass filter passes signals which are predominantly noise or, in this case, this filter passes all frequencies above approximately 6 Hz and the upper limit is established by the highest frequency at the output of U11 which is about 20 Hz. The high-pass output rollof is at approximately unity gain. The output 22 of U14 in the bandpass stage has a lower pole or cutoff at 0.5 Hz and an upper pole or cutoff at 6 Hz. It also has unity gain at rolloff. The output of low-pass operational amplifier U12 is at terminal 23 in this stage and at unity gain, passes all frequencies below 0.5 Hz with the low limit established by the output of U11 of about 0.1 Hz. The purpose of operational amplifier stages U13, U14 and U12 is to determine the permissible frequency ranges for normal motion which is in the passband of from 0.5 Hz to 6 Hz in the protected environment and "noise". The filter also functions to preserve noise which would be outside of that range. This feature differs from prior motion detectors which have a bandpass output only and noise is disregarded in the signal processing.

The signal at the output 21 of high-pass amplifier U13 is delivered over a conductor 24 to an absolute value amplifier comprising operational amplifier U24. This amplifier has a feedback resistor R19 and an input R20 which have values that result in unity gain. The input signal to the noninverting input of U24 is developed on R21 which also connects to floating ground. The input signal to U24 may be positive or negative and, therefore, is fed to the amplifier through polarity directing diodes CR3 and CR4. The absolute value of the input signal appears on output terminal 25 of U24.

Signals in the bandpass frequency are delivered from output terminal 22 of U14 over a conductor 26 to an absolute value amplifier circuit comprising operational amplifier U22. This amplifier has a feedback resistor R24 and an input resistor R22 in its inverting circuit and it has a divider resistor R23 in its noninverting circuit. As in the case of U24, the resistors associated with operational amplifier U22 may have the same value to produce unity gain. Signals in the bandpass frequency of 0.5 Hz to 6 Hz from U14 may also be positive or negative so they are again directed to polarity directing diodes CR5 and CR6. The absolute value of the signal fed into amplifier U22 appears on its output terminal 27.

The output signal from terminal 23 of low-pass filter section U12 is fed over a conductor 28 to an absolute value circuit including operational amplifier U23. This amplifier has a feedback resistor R27 and an input resistor R25 in its inverting circuit and a resistor R26 connected to its noninverting input and to floating ground. It also has polarity directing diodes at CR7 and CR8 in its input circuits to account for the fact that the input signal through this amplifier may also be positive or negative. The absolute value of the signal appears on the output terminal 29 of operational amplifier U23.

It will now be evident that three signals are available. The first, appearing at the output 29 of unity gain operational amplifier U23, is the absolute value of the signal that has been passed by low-pass filter section U12. As indicated, the frequency range of this signal is below 0.5 Hz and is primarily due to disturbances in the protected area which may be classed as noise. The second signal, appearing at the output 25 of operational amplifier U24, is the absolute value of the signal which is passed by high-pass filter section U13. The frequency range of this signal has a low limit or sharp rolloff at about 6.0 Hz and extends maximally flat to at least 20 Hz where some rolloff occurs. This band is also predominantly noise and is treated as such. The third signal, appearing at output 27 of operational amplifier U22 is the absolute value of the signal which is passed by bandpass filter section U14. As indicated, the bandpass is in the range of 0.5 Hz to 6.0 Hz and is the kind of signal that is pronounced when there is true movement by an intruder in the protected area.

The three absolute value signals are next summed in an operational amplifier U21. The low-pass signal from U23 is fed through input resistor R28 to summing point 30 and then to the inverting terminal of amplifier U21. The high-pass signal is fed through input resistor R29 to summing point 30 and the inverting input of amplifier U21. The bandpass signal is fed to the noninverting input of amplifier U21. Thus, the high and low-pass absolute value signals are summed at the inverting input of U21 and subtracted from the bandpass signal which is also supplied to U21. At the output 31 of U21 there will be a signal which varies in amplitude as a function of the incoming amplitudes of the low-pass, and bandpass and high-pass signals. Operational amplifier U21 is also provided with a feedback circuit including a potentiometer R30 which can be adjusted to balance or weight noise as compared with the bandpass signal which corresponds with movements of an intruder.

Those skilled in the electronic arts will appreciate that means other than a state variable filter may be used to extract the information or bandpass signal from the rest of the frequency spectrum and to retain the remaining signal while still allowing for summation and weighting of the signal outside of the information band. Also, the high and low pass signals might be summed before conversion to their absolute values in which case one of the absolute value amplifiers might be dispensable. The illustrated circuit is considered desirable however, because it permits establishing the desired Q and simplifies weighting.

In accordance with the invention, the useful information derived from the output 31 of U21 is a dc offset error. A negative error at 31 in reference to zero center or floating ground corresponds, in this example, with an excessive noise condition and a positive offset error corresponds with intruder movement or a true information signal and dictates an alarm condition. All stages are dc coupled.

Figure 4:
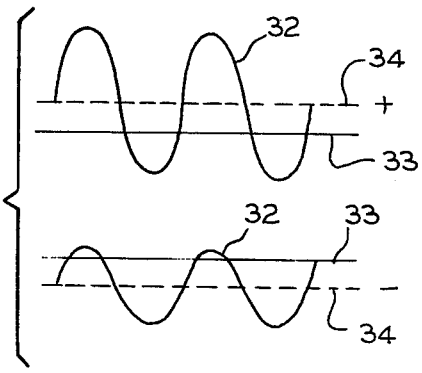
FIG. 4 shows some waveforms which are used to explain one aspect of the invention; and, FIG. 5 is a plot of gain versus frequency for a filter used in the system.

The general nature of the output signal from U21 is exemplified in FIG. 4. The signal at output 31 is marked 32 in FIG. 4 and is shown as sinusoidal although, in reality, it is somewhat more complex. The upper waveform 32 is shown in reference to the floating ground reference level marked 33 and the amount of positive offset is evident from the distance between the symmetry line 34 of the waveform and reference level 33. In this circuit, a positive offset at the output 31 of U21 results in an alarm condition as will be explained. The lower waveform 32 in FIG. 4 is symmetrical about line 34 which is in the negative direction from floating ground reference level 33. This negative offset is indicative of noise.

Figure 5:
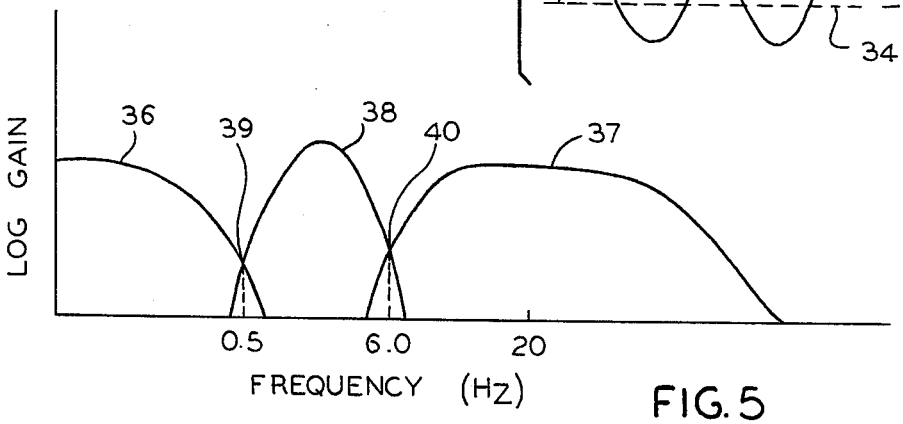

The frequency ranges of the high-pass, low-pass and bandpass filters involving operational amplifiers U13, U12 and U14, respectively, have been alluded to earlier. Their relationships may be conveniently discussed in reference to FIG. 5 which will be examined before continuing the discussion on how signals at output 31 of U21 are further process in the noise and motion comparator. Actually, the gain-frequency relationships in FIG. 5 are representative of those existing after the signal from U21, designated E2, is further processed by integrating with operational amplifier U42 in FIG. 3 as will be explained. Thus, FIG. 5 illustrates the rolloff of the whole filter circuit. The Bode plot for the low-pass filter is marked 36 in FIG. 5. Note the gain of this filter rolls off substantially at above 0.5 Hz. The Bode plot of the high-pass filter is marked 37 and the gain of this filter rolls off substantially at below 6.0 Hz and it also rolls off well beyond 20 Hz. The plot of the bandpass filter is marked 38; it has a sharp rolloff at opposite ends of the range of 0.5 Hz and 6.0 Hz. Note that there are sharp notches 39 and 40 at substantially 0.5 and 6.0 Hz. Because of the summing occurring at amplifier U21, and subsequent amplification of integrating operational amplifier U42 the slightest frequency shift will result in the signal being on one side or another of the 0.5 Hz and 6.0 Hz frequencies. For example, in a practical embodiment of the circuit described herein, 0.499 Hz is on one side of the notch and 0.500 Hz is on the other side. This is true even though noise is random and extends all across the approximately 0.1 Hz to 20 Hz range of the input signal at input terminal 18.

Figure 3:
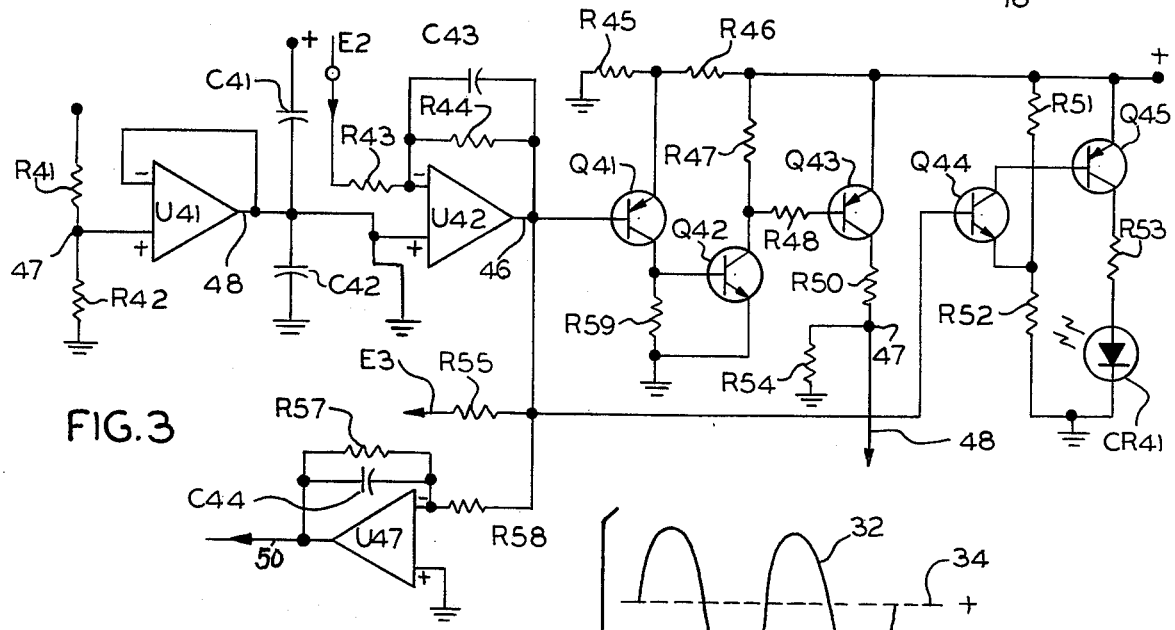
FIG. 3 is a diagram of a circuit which cooperates with that in the preceding figure to integrate processed signals, to control an alarm device and to indicate the amount of environmental noise.

The general discussion of the circuitry and how the signal is processed will now continue in reference to FIG. 3. In this figure, the input signal, which constitutes the output signal from output 31 of amplifier U21 is marked E2. This signal is supplied to an operation amplifier U42 which is connected as an integrator. The basic function of the integrator is to convert the output signal from U21 from a voltage to a signal corresponding with time. The integration time constant may be approximately one to two seconds, depending on signal magnitude. Amplification may be on the order of fifty. Thus, signal is supplied to the inverting input of U42 through input resistor R43. The integrating feedback circuit comprises a capacitor C43 and resistor R44. The signal appearing at the output 46 of U42 is dc and inverted so that now a negative going signal corresponds with an alarm and a positive going signal corresponds with a noise condition. The noninverting input of U42 is supplied with the floating ground or reference voltage level which has been mentioned previously. The full supply voltage is applied to the top of a voltage divider comprised of resistors R41 and R42. R42 is connected to ground. The midpoint 47 of the divider is connected to the noninverting input of a unity gain operational amplifier U41. A voltage at the output 48 of U41 is one-half the voltage of the single polarity power supply which is applied to the R41 and R42 divider. Thus, the voltage at output 48 and, the voltage at noninverting input of U42, is halfway between supply and ground and is used as a virtual or floating ground for all operational amplifiers in the circuit. Capacitors C41 and C42 are provided for smoothing.

As stated, the integrated output signal from U42 may be negative with respect to the floating reference, due to inversion, if there is an alarm condition and it will be positive, due to inversion if noise predominates.

Means are provided for further stabilizing the output of U11 which is the input amplifier to the part of the circuitry shown in FIG. 2. This stabilizing effect is obtained with feedback from U42 in FIG. 3 by way of resistor R55 which leads to terminal E3 in FIGS. 3 and 2. In FIG. 2, the feedback signal is fed through diode CR9 and resistor R17 whereby it produces a potential for controlling field effect transistor Q1 in the gain control circuit for U11. This portion of the circuit becomes active only when the environment becomes excessively noisy in which case the output of U42 is driven to a positive condition proportional to noise level. The amount of feedback is preferably such that the gain of U11 will be reduced substantially during high persistent noise but preferably by no more than 30% so that too much sensitivity is not lost. It is desirable to reduce the gain because during periods of environmental instability the amplifying circuits are more likely to allow a signal appearing as motion by an intruder to pass through although the signal is really due to noise. A feature of the feedback circuit is that it allows amplifier U11 to return to maximum gain if motion is detected for a short period. However, even though a gain reduction is being experienced due to noise, the system can very quickly negate its suppressed condition and return to normal sensitivity if motion is detected.

Assume, for example, that there is high persistent noise in the protected environment and, hence, in the detected signal and recognize that a basic concept employed in the comparator circuitry is that the integral of truly random noise is zero. During persistent noise the output signal, E2, from operational amplifier U21 in FIG. 2 is negative with respect to the floating reference in the absence of substantial bandpass signal. Under this condition the output signal from integrator U42 in FIG. 3 will go positive and the gain of input stage amplifer U11 will be reduced. This reduces the sensitivity of the system to intruder induced bandpass signal if such signal should suddenly occur. But due to the weighting given to bandpass signals by the summing action at U21, the output of U42 will tend to go negative quickly when a bandpass signal occurs. More specifically, due to properly chosen resistors R28 and R29 for the noise signal inputs to U21 in FIG. 2, the noise inputs are reduced and there is weighting in favor of bandpass signal so that the bandpass signal 38 in FIG. 5 seems larger in amplitude. This causes a relatively slow positive trend at output 46 of integrator U42 for noise but a many times faster negative trend for bandpass signal. This gives the comparator a capability of responding to motion in the presence of noise.

The action is regenerative in that as soon as the output of integrator U42 starts to go negative due to a bandpass signal, feedback to input amplifier U11 is markedly reduced and its gain is quickly returned to normal so the signal corresponding with bandpass will be fully amplified and the positive signal due to noise at the output of the integrator will be nullified within a second or two, depending on the chosen time constant of the integrator.

The action just discussed also prevents the system from being defeated by a prospective intruder introducing a large amount of noise in the protected environment. As explained in the preceding paragraph, at worst, this would only reduce sensitivity of the comparator but sensitivity to bandpass signals would be quickly restored when an intruder moved in the protected area. Because of the values used for R1 in FIG. 2 and R55 in FIG. 3, feedback to Q1 from U3 has many times the gain reducing effect on U11 than does feedback of E3 signal on U11. This allows for substantial rejection of transient noise and motion signals at the input 18 to U11, but only small reduction in sensitivity due to positive potential E3 corresponding with excess noise. In respect to positive high noise feedback signal to Q1, R55 forms a divider through CR9 with R17 which connects to the gate of Q1 to provide the desired feedback. In respect to transient noise and motion signals from U3, R1 forms a divider through CR10 with R17. The diodes CR9 and CR10 isolate the feedback signals and allow each of them to operate independent of the other. In cases where very low environmental noise can be expected to prevail, it is conceivable that the feedback circuit comprised of diode CR9 and resistor R55 might not be needed to suppress sensitivity. Also note that a slight positive voltage at output 46 of integrator U42 will take longer to overcome or go negative in correspondence with an alarm condition, so if a slightly noisy condition exists the amount of motion required for an alarm to occur will increase but the range at which motion by an intruder can be detected remains constant. The midpoint or biasing point of the divider connects to the gate G of field effect transistor Q1. Even if Q1 were to fail, U11 would not be biased off because R9 is in parallel with it and would still allow ac signal input.

A further important feature of the circuit in FIG. 3 is the provision of means for determining the amount of environmental noise when the system is being installed or at any time that a test is desired so that the sensitivity of the system can be properly adjusted for environmental conditions. For this purpose a circuit comprising transistors Q44 and Q45 and a light emitting device such as diode CR41 are provided. Q44 has a biasing divider comprised of resistor R51 and R52 connected from power supply to ground with the midpoint connected to the emitter of transistor Q44. The base of Q44 is supplied with the signal from U42. A negative signal from U42 will keep transistor Q44 turned off. However, a positive signal, corresponding with noise, of sufficient magnitude will forward bias the base-emitter circuit of Q44, thus turning it on. This will cause current flow in the emitter-base circuit of Q45, thus turning it on and thereby supplying a voltage and current to light emitting device CR41 through limiting resistor R53. The biasing of Q44 is such that it will not turn on nor will CR41 turn on unless the voltage corresponding with noise is above a predetermined level such as 2 volts above the reference voltage of U41, for example. This provides a deadband. Light emitting device CR41 will turn on whenever noise is unduly high so that suitable steps can be taken to reduce noise and thus keep the system at maximum sensitivity. When the system is installed and it is found that CR41 has turned on, it is an indication to the installer that the possibility of problems due to environmental disturbances exist and should be corrected so that sensitivity of the system may be maximized.

The alarm circuit comprising transistors Q41, Q42 and Q43 will now be discussed. The output signal from U42 is supplied to the base of transistor Q41. The emitter of this transistor is connected to the midpoint of a divider comprised of R45 and R46. When a signal of some predetermined value such as 2.5 volts negative with respect to floating ground is obtained, the emitter-base circuit of Q41 becomes conductive as does this emitter-collector circuit. This produces a biasing voltage across R59 which drives Q42 on. Q42 has a collector resistor R47. When Q42 becomes conductive, the collector goes negative and a negative voltage is produced through R48 which is applied to the base of a transistor Q43. Q43 has resistor R50 and R54 connected between its collector and true ground such that a predetermined voltage, sufficient to driven an alarm device, not shown, will be developed at junction point 47. Terminal 48 may connect to the alarm device. The 2.5 volts required to trigger Q41, is a deadband which allows the circuit to disregard any signal which may be noise but is somehow processed as a true motion signal. Another function of the plus and minus deadband range is to allow for normal production variances in active and inactive components.

It will be evident that long-term inherent environmental noise may be balanced or maintained in a proper proportion with respect to valid information signals by adjustment of potentiometer R30. This potentiometer permits changing the weighted pair of signals to R28 and R29 relative to the information band but it does not change the level of the information signal. When R30 is turned to zero or minumum resistance position, feedback approaches 100% and the bandpass is thereby widened. More noise weighting and a narrower bandpass is obtained if R30 is adjusted for greatest resistance. There is then more signal for integrator U42 in FIG. 3 to work with. In any case, controlling noise weighting with R30 can be done without altering sensitivity of the device to motion for normal movement speeds in a protected area. Sensitivity to motion, on the other hand, may be set with sensitivity adjusting potentiometer R32 associated with the first stage operational amplifier U11. Motion is always more heavily weighted than noise, at any frequency, so motion takes precedence over noise.

Of course, if there is a high noise level developed in the protected area, a little more time is required for integrator U42 to produce an output in which the effective noise is cancelled by true motion in the 0.5 Hz to 6 Hz band. It is easy to obtain a response within one to two seconds, however, regardless of noise level. This is not at all disadvantageous as compared with the great advantage of rejecting noise and avoiding false alarms.

A useful but not indispensable feature of the system is to provide means for notifying an attendant if noise were to persist above a predetermined level and beyond a predetermined time which would be indicative that an environmental condition has reduced the integrity of the security system. This feature is achieved in FIG. 3 with an operational amplifier U47 connected as an integrator. It has an integrating circuit comprised of C44 and R57 and an input resistor R58. The inverting input of U47 is supplied with the integrated signal output from U42. If the output of U42 goes positive, corresponding with noise, for said predetermined time and level, and if the time constant of the integrator U47 is properly chosen, it will change state in response to noise. The output at 50 of U47 may thus be used to control a warning or notifying device. For example, the output could control another a transistor such as Q41 in another alarm circuit similar to that which is controlled by Q41.

In the illustrated system, the component values listed below were found to provide excellent results. However, it should be understood that this information is provided for completeness of the disclosure and should not be taken to limit the scope of the invention. It should also be noted that the value and particular characteristics of the circuit components are for a system in which the audio frequency radiated from the speaker is about 810 Hz and that different value circuit components would be used for ultrasonic and microwave frequencies and for other audio frequencies.

| Components | Description |
|---|---|
| Resistors: | |
| R1 | 33,000 ohms |
| R2, R5, R28, R43 | 15,000 ohms |
| R3, R4, R6, R9, R11, R12, R13, R14, R16, R19, R20, R21, R22, R23, R24, R25, R26, R27, R30 | 10,000 ohms |
| R7, R32, R59 | 1 megohm |
| R8, R18 | 470 ohms |
| R17, R41, R42, R47, R48, R50, R52, R54, R55 | 68K |
| R29, R45 | 22,000 ohms |
| R15 | 6800 ohms |
| R44 | 680,000 ohms |
| R51, R46 | 47,000 ohms |

-continued

| Components | Description |
|---|---|
| R53 | 2200 ohms |
| R31 | 100,000 ohms |
| Capacitors: | |
| C4, C5, | 10 microfarads |
| C2 | 330 microfarads |
| C3 | .01 microfarads |
| C43 | 22 microfarads |
| C1, C41, C42 | 1 microfarads |
| Diodes: | |
| CR1 to CR10 | 1N 914 |
| CR41 | MV 50 |
| Transistors: | |
| Q1 | 2N 5461 |
| Q41, Q43, Q45 | 2N 3638 A |
| Q42 | 2N 5306 |
| Q44 | 2N 2924 |
| Operational Amplifiers: | |
| U11 - U14 (Quad) | LM 324 |
| U21 - U24 (Quad) | LM 324 |
| U3, U41, U42 | LM 741 |

I claim:

1. For use with apparatus that provides a composite signal comprised of a substantially continuous spectrum of frequencies including frequencies designated as noise and defined by selected lower and upper bandwidth limits and a substantially predetermined band of frequencies coincident with a portion of said spectrum designated as the desired information band having lower and upper bandwidth limits within said spectrum; means for discriminating signals corresponding with frequencies within said information band from signals corresponding with noise, comprising:

first amplifier means having input and output means, said input means including means for receiving said composite signal and said amplifier means having a bandwidth response corresponding substantially with said predetermined bandwidth of said noise, said amplifier means producing an unclipped output signal corresponding with said composite signal within said noise band, means for substantially separating from said output signal signals which correspond with said information frequency band from signals which correspond with said noise frequencies, means for converting said information and noise signals, respectively, to corresponding absolute value signals, means for producing a reference potential, amplifier means having input means for said absolute value signal corresponding with said noise signal and input means for said absolute value signal corresponding with said information signal, said last named amplifier means being constructed and arranged to produce an alternating output signal which is proportional to the difference between said noise and information input signals and which has a dc offset relative to said reference potential having a polarity that depends upon which of said noise and information corresponding signals is greater, means for converting said alternating output signal from said last named amplifier means to a signal related to time and having a polarity relative to said reference potential which is functionally related to the polarity of said offset signal and corresponds with which of said noise signal or said information signal is dominant, feedback means coupling said signals which are related to time to said input means of said first amplifier means, said feedback mens being responsive to signals having a polarity corresponding with noise for reducing the sensitivity of said first amplifier means proportionately to the magnitude of the noise component of said signals, and means responsive to said time related signal reaching a predetermined amplitude of one polarity for indicating the existence of a predominant information signal.

2. The signal discriminating means as in claim 1 including:

means responsive to said time related signal reaching a predetermined amplitude of a polarity opposite of said one polarity by indicating the existence of a predominant noise signal.

3. The signal discriminating means as in claim 1 including:

means for selectively integrating the component of said time related signal from said converting means which corresponds with dominant noise to thereby produce a signal which is representative of the amount of noise component in said spectrum of frequencies, and means for indicating the existence of said representative signal.

4. The signal discriminating means as in claim 1 including:

feedback means coupled between said input and output means of said first amplifier means, said last named feedback means including converter means for converting a signal to its absolute value, said converter means having input means coupled with the output means of said first amplifier means and said converter means having output means coupled with the input means of said first amplifier means, said last named feedback means being operative to cause said first amplifier means to produce compressed signals.

5. The signal discriminating means as in claim 1 wherein:

said feedback means comprises variable resistance means coupled to said input means of said first amplifier means, and means for controlling said variable resistance means to vary its resistance and thereby reduce the sensitivity of said first amplifier means to noise within a predetermined limit corresponding with increases of said time related signal representative of dominant noise.

6. The signal discriminating means as in claim 1 wherein said first amplifier means is a compressor amplifier means.

7. The signal discriminating means as in claim 1 wherein said first amplifier means is a logarithmic amplifier means.

8. An intrusion alarm system comprising:

means for generating a signal having a predetermined frequency, means for converting said signal having a predetermined frequency into outgoing signals that are radiated into a protected area and for receiving from said area incoming signals that depend on conditions therein, means for developing a composite signal dependent on the phase difference between outgoing and incoming signals, said composite phase-dependent signal being comprised of a spectrum of frequencies a portion of which is between lower and upper frequency limits defining a first band of frequencies corresponding with noise signals from said area and containing a second frequency band within said first banb and corresponding primarily with desired information when present such as with movement of an intruder in said area, amplifier means having input and output means, said input means including means for receiving said composite signal and said amplifier means being operative to amplify signals within said first band of frequencies and to produce an unclipped output signal, filter means operative in response to the input of said amplified composite signal to provide output signals having frequencies corresponding substantially with those of said first band and said second band, respectively, means for converting said last named first band and second band signals to absolute values, summing means operative to sum said first band signal which corresponds primarily with noise and second band signal which corresponds primarily with intruder movement and to produce an alternating output signal which will have a dc offset of a polarity relative to a reference potential that depends on the relative magnitude of said first and second band signals, means for converting said alternating output signal to a signal related to time and having a polarity relative to said reference potential which is functionally related to the polarity of said offset output signal, feedback means coupling said signals which are related to time to said input means of said amplifier means, said feedback means being responsive to signals having a polarity corresponding with noise for reducing the sensitivity of said amplifier means proportionately to the noise component of said signals, and means for indicating movement of an intruder in the protected area in response to a signal of predetermined magnitude and polarity from said last named means for converting.

9. The system as in claim 8 wherein said signal which is radiated to said protected area has a frequency in the range of 400 Hz to 2000 Hz.

10. The system as in claim 8 wherein said first frequency band is substantially 0.1 Hz to 20 Hz and said second frequency band is substantially 0.5 Hz to 6.0 Hz.

11. The system as in claim 8 wherein said signal which is radiated into said protected area is about 810 Hz, said first frequency band is substantially 0.1 Hz to 20 Hz and said second frequency band is substantially 0.5 Hz to 6.0 Hz.

12. The system as in claim 8 wherein:

said filter means comprises high-pass, low-pass and bandpass filter means for separating said composite signal into high-pass and low-pass signals, respectively, which have a frequency content corresponding primarily with noise and a bandpass signal having a frequency content corresponding primarily with intruder movements that are sought to be detected, said means for converting said signals to absolute values thereof comprising means for converting each of said high-pass, low-pass and bandpass signals to absolute values, said summing means having input means for the sum of said low-pass and high-pass signals and for said bandpass signal whereby to produce said alternating output signal that depends on the relative magnitude of said summed signals and said bandpass signal.

13. The system as in claim 12 wherein said low-pass filter means passes signals having a frequency band substantially of 0.1 to 0.5 Hz, said bandpass filter means passes signals having frequency band substantially of 0.5 Hz to 6.0 Hz and said high-pass filter means having a frequency band substantially of 6.0 Hz to 20 Hz.

14. The system as in claim 12 wherein:

said summing means includes means for controlling the weight of said summed signals corresponding with noise relative to said signal corresponding with desired intruder movement information.

15. The system as in claim 12 wherein:

said summing means comprises an operational amplifier having an inverting input and a noninverting input and an output and a feedback circuit coupling its output to its inverting input, said feedback circuit including variable impedance means, said absolute values of said low-pass and high-pass signals being summed at said inverting input and said absolute value of said bandpass signal being applied to said noninverting input, said variable impedance means being for varying the magnitude of said sum of said low-pass and high-pass absolute value signals relative to said absolute value of said bandpass signal.

16. The system as in claim 8 including:

feedback means coupled between said output and input means of said amplifier means, said last named feedback means being operative to cause said amplifier means to function as a signal compressor.

17. An intrusion alarm system comprising:

means for generating an electric signal at a predetermined frequency, means for converting said signal into an outgoing sonic signal at a corresponding frequency which is radiated into a protected area in which movement of an intruder is to be detected and for receiving from said area incoming signals that depend on conditions therein, means for developing a composite signal dependent on the phase difference between said outgoing and incoming signals, said phase-dependent signal being composed of a continuous band of frequencies between lower and upper band limits characteristic of unwanted noise produced in said area and a second band of frequencies having upper and lower limits between the aforesaid limits and characteristic of movements of an intruder when present in said area, compressor amplifier means having input and output means, one of said input means receiving said composite signal and said amplifier means being operative to produce an unclipped output signal corresponding with said composite input signal, means for reducing the gain of said amplifier means to a predetermined lower gain limit as a function of the magnitude of a signal corresponding with noise in said composite signal, filter means for separating said composite output signal from said amplifier means into three signals corresponding, respectively, with a low frequency band having lower and upper frequency limits and corresponding with noise, an intermediate frequency band having lower and upper limits and corresponding with noise and movement of an intruder, and a high frequency band having lower and upper limits and corresponding with noise, means for converting said signals which correspond with low, intermediate and high frequency bands to absolute values thereof, respectively, means for subtracting from said signal absolute value which corresponds with said intermediate frequency band the sum of said signals the absolute values which correspond with said low and high frequency bands and for producing a time varying error signal having a dc offset of one polarity with respect to a reference when signal corresponding with noise predominates and of the opposite polarity with respect to said reference when signal corresponding with intruder movement predominates, means for integrating said error signal continuously to thereby convert said time varying signal to a dc signal whose magnitude and polarity corresponds with whichever signal predominates, and means for indicating an alarm condition corresponding with intruder movement in response to said dc signal attaining a predetermined magnitude at one of said polarities.

18. The system as in claim 17 including:

means controlled by said dc signal and responsive to said dc signal having a polarity corresponding with noise and a predetermined minimum magnitude for providing an indication of the presence of noise, whereby to enable said protected area to be tested for noise in the absence of intruder movement.

19. The system as in claim 17 including:

further integrating means for integrating said dc signal when the latter has a polarity corresponding with noise to provide a signal corresponding with the noise that prevails in the system during normal operation thereof.

20. The system as in claim 19 including means for producing an alarm in response to said signal provided by said further integrating means reaching a predetermined magnitude to thereby warn that high noise may be developing during operation of the system.

21. The system as in claim 17 wherein said composite output signal from said compressor amplifier means is in a band limited substantially at 0.1 Hz and 20 Hz, said low frequency signal from said filter means is in a band limited substantially at 0.1 Hz and 0.5 Hz, said intermediate frequency signal is in a band limited substantially at 0.5 Hz and 6.0 Hz and said high frequency signal is in a band limited substantially at 6.0 Hz and 20 Hz.

22. The system as in claim 17 wherein:

said compressor amplifier means comprises an operational amplifier having said output means and said input means comprise the inverting and noninverting inputs thereof, feedback loop means coupled to said output means for developing a first control signal which is functionally related to the magnitude of said composite output signal, variable impedance means coupled to said noninverting terminal and having a control element controlled by said control signal to vary the impedance of said means and thereby control the gain of said amplifier means and the compression of said composite signal.

23. The system as in claim 22 including means for feeding back said dc signal as a second signal to said control element of said variable means independently of said first control signal, said variable impedance means responding to increasing of said dc signal having polarity which corresponds with noise by decreasing the gain and sensitivity of said amplifier means to noise related incoming signal.

24. The system as in claim 23 including means for limiting said second signal which is fed back to said control element such that the gain of said amplifier means is not reduced to less than about 30% of the normal gain of said amplifier means.

* * * * *